United States Patent [19]

Ferrero

[11] Patent Number: 4,589,553

[45] Date of Patent: May 20, 1986

[54] PACKAGE FOR FOOD PRODUCTS

[75] Inventor: Pietro Ferrero, Rhode St. Genese, Belgium

[73] Assignee: Ferrero S.p.A., Alba, Italy

[21] Appl. No.: 620,829

[22] Filed: Jun. 15, 1984

[30] Foreign Application Priority Data

Jul. 22, 1983 [IT] Italy ..... 53588/83[U]

[51] Int. Cl.[4] ..... B65D 85/60; B65D 85/78

[52] U.S. Cl. ..... 206/525; 229/DIG. 13; 426/115

[58] Field of Search ..... 206/525, 494; 229/DIG. 13; 426/114, 115

[56] References Cited

U.S. PATENT DOCUMENTS

| | | | |
|---|---|---|---|
| 1,830,246 | 11/1931 | Sanford | 229/DIG. 13 |
| 1,844,066 | 2/1932 | Hughes | 206/525 |
| 2,112,143 | 3/1938 | Costa et al. | 206/627 |
| 2,179,504 | 11/1939 | Hasbrook | 206/627 |
| 3,003,207 | 10/1961 | Powers | 229/DIG. 13 |
| 3,355,082 | 11/1967 | Wood | 229/DIG. 13 |
| 3,446,416 | 5/1969 | Epstein | 229/DIG. 13 |
| 3,610,512 | 10/1971 | Hermann | 229/DIG. 13 |
| 3,640,381 | 2/1972 | Kanada et al. | 383/119 |
| 4,511,039 | 4/1985 | Siemek | 229/DIG. 13 |

FOREIGN PATENT DOCUMENTS

| | | | |
|---|---|---|---|
| 651804 | 4/1951 | United Kingdom | 383/119 |

*Primary Examiner*—William Price
*Assistant Examiner*—Brenda J. Ehrhardt
*Attorney, Agent, or Firm*—Bernard, Rothwell & Brown

[57] ABSTRACT

A package for a rigid or semi-rigid food product has a wrapper sheet which encloses the product and which can be torn along a transverse rupture line, and a take-up member which at least partly surrounds the portion of the wrapper sheet between one end of the product and the rupture line and by means of which the product may be held for consumption.

8 Claims, 5 Drawing Figures

PACKAGE FOR FOOD PRODUCTS

The present invention relates to packages for food products and relates particularly to a package for rigid or semi-rigid food products.

The object of the present invention is to provide a package for a sweet product which, as well as protecting the product before consumption, allows the consumer to grasp the product itself, to carry it to his mouth, and to consume it completely without touching it directly with his hands, thus avoiding soiling his fingers.

According to the invention this object is achieved by means of a package characterised in that it comprises:

a wrapper sheet which encloses the product and which can be torn along a rupture line extending in a transverse intermediate plane relative to the product, and a take up member which at least partly surrounds a portion of the wrapper between one end of the product and the said transverse intermediate plane and allows the product itself to be grasped.

By virtue of this characteristic the packaged product may be grasped and brought to the mouth for consumption after the wrapper has been torn without the hands touching the product directly and thus without the fingers becoming soiled, for example, where the product is greasy or sticky. The package according to the invention is thus very useful both from a hygenic point of view and from the point of view of practicality in use.

Figure 1:
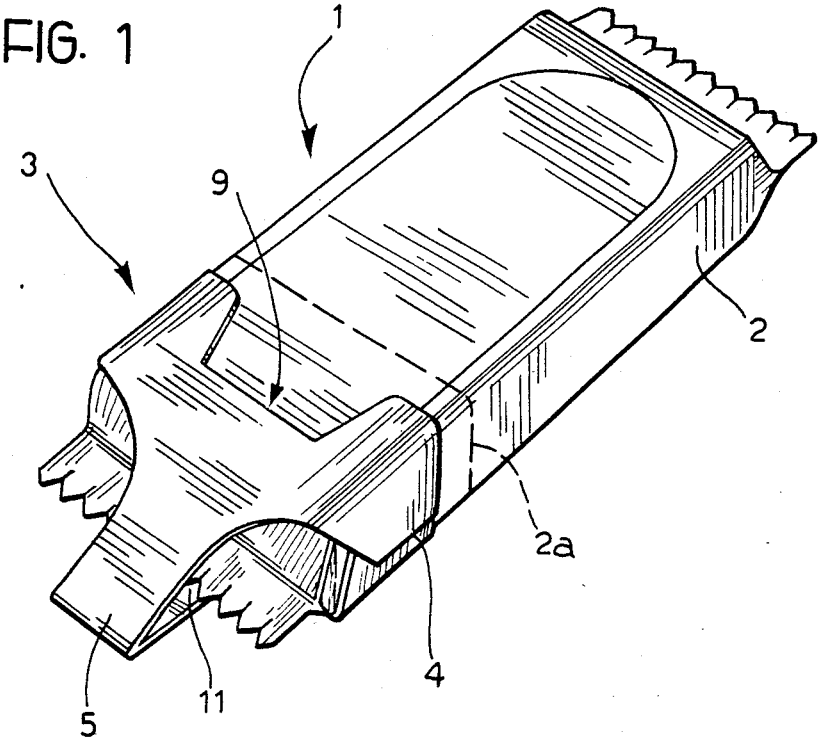
Figure 3:
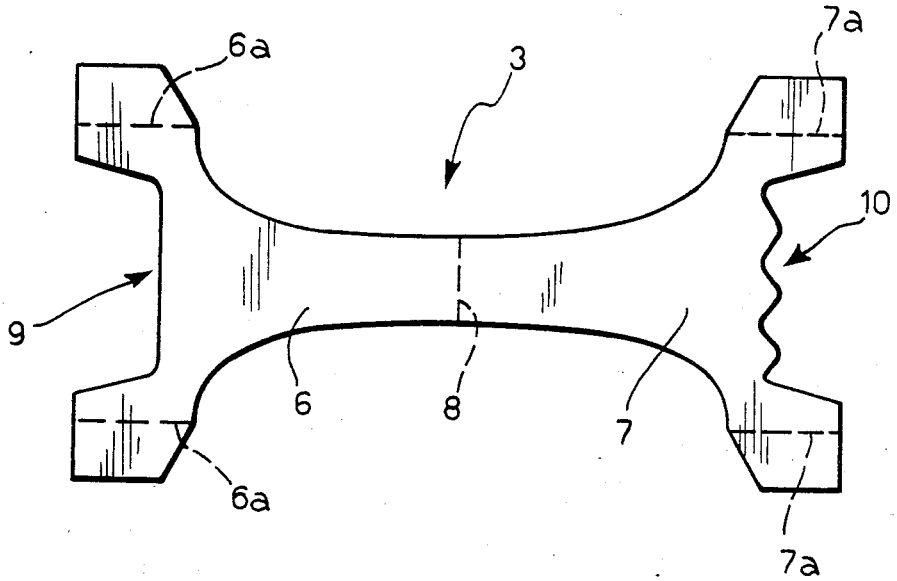
Figure 2:
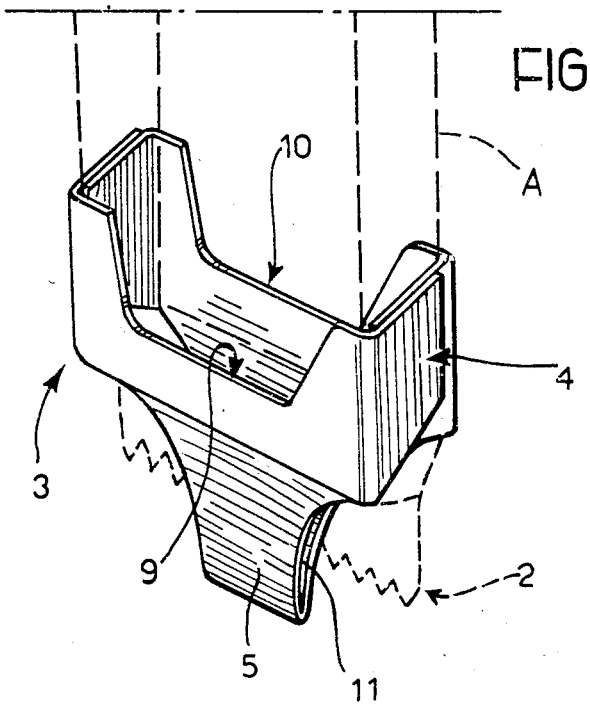
Figure 4:
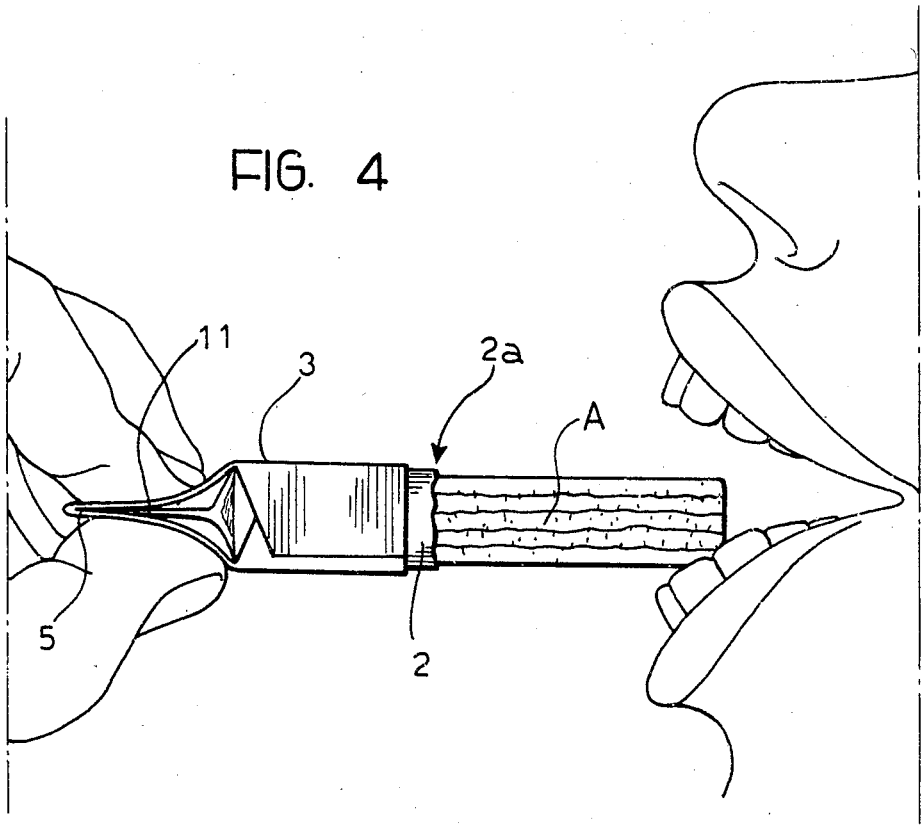
Figure 5:
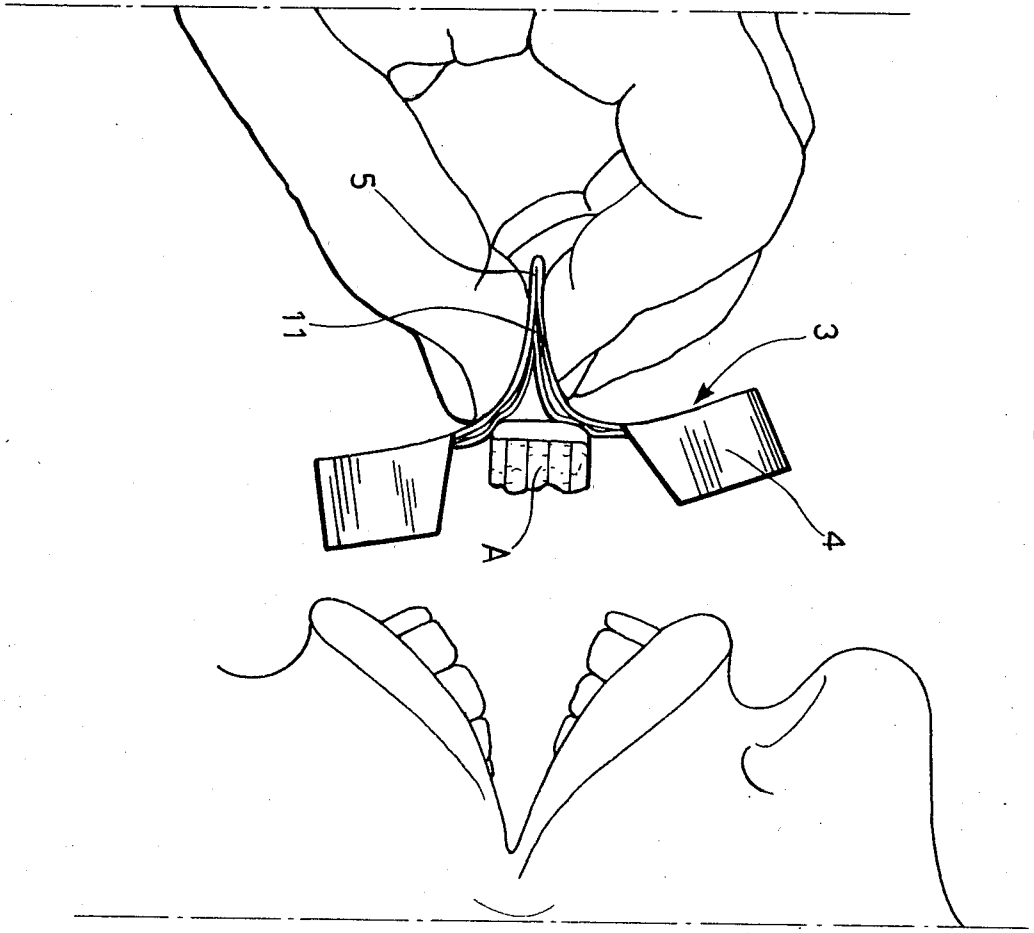

Further characteristics and advantages of the invention will become apparent from the following description, given purely by way of non-limiting example, with reference to the appended drawings, in which:

FIG. 1 is a perspective view of a food product provided with a package according to the invention, FIGS. 2 and 3 illustrate one of the elements illustrated in FIG. 1 in detail in an assembled form and in a flat extended form respectively, and FIGS. 4 and 5 illustrate schematically two successive stages in the consumption of the product of FIG. 1.

In the drawings a package generally indicated 1 contains a sweet product A constituted, in the example illustrated, by a small filled sponge cake covered with a layer of cocoa. The cake A is elongate and has an approximately rectangular cross section.

A flexible wrapper sheet, indicated 2, is of the type generally called a "flow-pack", and is constituted by a tubular wrapper of aluminium foil having a longitudinal seam (not visible in the drawings) and two heat-sealed end seams.

The wrapper 2, which wraps the cake A so as to protect it until consumption, can be torn along a rupture line *2a* which extends in a transverse intermediate plane relative to the cake A.

A take-up element, generally indicated 3, allows the product to be grasped and brought to the mouth after the protective wrapper 2 has been torn.

The take-up member 3 includes a collar part 4 which surrounds one end of the protective wrapper 2. More particularly, the collar part 4 surrounds the portion of the wrapper 2 between one of the ends of the product and the transverse intermediate plane in which the rupture line *2a* is located.

The take-up member 3 further includes a finger grip 5 which projects from the collar part 4 outwardly of the package 1 in an approximately axial direction relative to the cake A and the protective wrapper 2.

As is best seen in FIG. 2, the take-up member 3 is constituted by a folded body of sheet material, for example thin card, the development of which is illustrated in FIG. 3. The member 3 includes two complementary T-shaped sections 6 and 7 which are mutually connected by their respective foot parts. Between these foot parts there extends a fold line 8 which allows the member 3 to be folded to bring the complementary sections 6 and 7 into positions facing each other.

Two U-notches indicated 9 and 10 are provided centrally of the edges of the head parts of the sections 6 and 7 opposite the finger grip 5.

Each of the complementary sections 6 and 7 also has further fold lines indicated *6a* and *7a* respectively which allow the ends of the head parts to be bent into a generally C-configuration.

The folding along the lines *6a*, *7a* is effected so that, after the complementary sections 6 and 7 have been brought into their facing positions, the folded ends of the head part of each section project towards the complementary section into positions of overlapping contact with the folded ends of the head part of this section. Under these conditions the head parts of the complementary sections 6 and 7 together define the collar part 4 of the take-up member 3 and may be connected together at their folded ends, for example by glueing.

The take-up member 3 thus formed is fitted onto the cake A wrapped in its wrapper 2 in the configuration illustrated in FIGS. 1 and 2. The take-up member 3 is fixed to the wrapper 2 by a drop of adhesive 11 (for example a heat-meltable adhesive of the so-called "hot-melt" type) applied between the foot parts of the complementary sections 6 and 7 and an end seam of the wrapper 2 housed between them.

In use, the package according to the invention is grasped by the take-up member 3 so as to allow the wrapper 2 to be torn along the rupture line *2a*. The tearing of the wrapper 2 is effected by any known system for example by means of a tear tongue attached to the wall of the wrapper 2 itself.

As a result of the tearing action, the wrapper 2 is divided into two parts, one of which, opposite the take-up member 3, may easily be removed, rendering accessible the portion of cake A previously wrapped therein.

The package may then be brought to the mouth as shown schematically in FIG. 4 for consumption of the portion of cake A from which the wrapper has been removed.

For the further consumption of the cake A, the wrapper 2 is torn in correspondence with the two notches 9 and 10 which open on the side of the collar part 4 opposite the finger grip 5.

After the tearing of the wrapper, the consumer may introduce his lips and/dental arches into the notches 9 and 10 which extend in correspondence with the larger opposite sides of the cake A to take up the end part of the cake A itself.

It should be noted that both the tearing of the wrapper 2 in correspondence with the notches 9, 10 and the taking up of the end part of the cake A may be achieved without the fingers coming into contact with the cake A itself.

In the final stage of consumption, in order to take the remainder of the cake A, the head parts of the complementary sections 6 and 7 which are not fixed to the wrapper 2 may be separated from each other and spread apart, the part of the wrapper 2 between them being torn at the same time, as shown schematically in FIG. 5.

Under these conditions, the consumer may bring the remainder of the cake to his mouth, what remains of the package being supported by the finger grip of the take-up member 3.

Naturally the effects of the present invention also extend to models which afford the same utility by using the same innovative concept.

What is claimed is:

1. A package for a rigid or semi-rigid food product, comprising in combination:

a wrapper sheet which encloses a food product having a generally rectangular cross-section, the wrapper sheet having a rupture line extending in a transverse intermediate plane relative to the product along which the wrapper sheet can be torn, and a take-up member which at least partly surrounds a portion of the wrapper sheet between one end of the product and the said transverse intermediate plane, the take-up member comprising a collar part which surrounds the said portion of the wrapper sheet and which is provided with two larger flat opposing sides, each of which has a generally U-shaped notch in its edge facing towards said transverse intermediate plane through which the portion of the product surrounded by the collar part can be rendered accessible, said take-up member being capable of being gripped to enable the wrapped product to be held.

2. Package as defined in claim 1, applicable to a food product having a rectangular cross-section, wherein the collar part which supports the said portion of the wrapper sheet is provided with two larger flat opposing sides, each of which has a U-notch in its edge facing towards said transverse intermediate plane through which the portion of the product surrounded by the collar part can be rendered accessible.

3. Package as defined in claim 1, wherein the take-up member includes finger grip means projecting outwardly of the package in a substantially axial direction with respect to the product.

4. Package as defined in claim 1, wherein the take-up member comprises a folded body of sheet material having two complementary T-shaped sections which face each other, each said section having a head part and a foot part, said sections being interconnected by their respective foot parts, and said head parts surrounding the said portion of the wrapper sheet.

5. Package as defined in claim 4, wherein the head part of each of the complementary sections of the take-up member is folded with a substantially C-shaped configuration open towards the head part of the other complementary section, the two folded sections forming a collar surrounding the said portion of the wrapper sheet.

6. Package as defined in claim 3, wherein the take-up member is connected to the wrapper sheet in correspondence with the said finger grip, whereby the collar part can be removed from the wrapper sheet while the product is held by the finger grip to render the portion of the product initially surrounded by the collar part itself accessible for consumption.

7. A package for a rigid or semi-rigid food product,- comprising in combination:

a wrapper sheet which encloses the product, the wrapper sheet having a rupture line extending in a transverse intermediate plane relative to the product along which the wrapper sheet can be torn, and a take-up member which at least partly surrounds a portion of the wrapper sheet between one end of the product and the said transverse intermediate plane, the take-up member including a collar part which surrounds the said portion of the wrapper sheet, the take-up member including finger grip means projecting outwardly of the package in a substantially axial direction with respect to the product to enable the wrapped product to be held, the take-up member being connected to the wrapper sheet in correspondence with the said finger grip, whereby the collar part can be removed from the wrapper sheet while the product is held by the finger grip to render the portion of the product initially surrounded by the collar part itself accessible for consumption.

8. A package for a rigid or semi-rigid longitudinally elongate food product, comprising in combination:

a wrapper sheet having two ends, the wrapper sheet enclosing a longitudinally elongate food product having a generally rectangular transverse cross-section, the wrapper sheet having a rupture line generally intermediate betwen the two ends of the wrapper sheet along which the wrapper sheet can be torn, the rupture line extending in a transverse intermediate plane relative to the product; and a take-up member including a collar part and finger grip means, the collar part surrounding a portion of the wrapper sheet only between one end of the product and the said transverse intermediate plane, the finger grip means projecting outwardly of the package in a substantially axial direction with respect to the product to enable the wrapped product to be held, the take-up member comprising two complementary T-shaped sections which face each other, each said section having a head part and a foot part, the head part of each of the complementary sections comprising a substantially C-shaped configuration open towards the head part of the other complementary section, the two folded sections forming said collar surrounding the said portion of the wrapper sheet, the head parts each including a generally flat side wherein each flat side opposes the other, each of which flat sides has a generally U-shaped notch in its edge facing towards said transverse intermediate plane through which the portion of the product surrounded by the collar part can be rendered accessible, said foot parts comprising said finger grip means wherein each of said foot parts opposes and is connected to the other, the take-up member being connected to the wrapper sheet in correspondence with the foot parts, whereby the collar part can be removed from the wrapper sheet while the product is held by the finger grip to render the portion of the product initially surrounded by the collar part itself accessible for consumption.

* * * * *